US011624557B2

(12) United States Patent
Parker

(10) Patent No.: US 11,624,557 B2
(45) Date of Patent: Apr. 11, 2023

(54) VACUUM DRYING KILNS AND CONTROL SYSTEMS THEREFORE

(71) Applicant: Green Mountain Mechanical Design, Inc., Warren, VT (US)

(72) Inventor: James Parker, Warren, VT (US)

(73) Assignee: Green Mountain Mechanical Design, Inc., Warren, VT (US)

( * ) Notice: Subject to any disclaimer, the term of this patent is extended or adjusted under 35 U.S.C. 154(b) by 255 days.

(21) Appl. No.: 17/250,283

(22) PCT Filed: Jul. 2, 2019

(86) PCT No.: PCT/US2019/040321
§ 371 (c)(1),
(2) Date: Dec. 28, 2020

(87) PCT Pub. No.: WO2020/010094
PCT Pub. Date: Jan. 9, 2020

(65) Prior Publication Data

US 2021/0207886 A1 Jul. 8, 2021

Related U.S. Application Data

(60) Provisional application No. 62/692,990, filed on Jul. 2, 2018, provisional application No. 62/693,365, filed on Jul. 2, 2018.

(51) Int. Cl.
*F26B 5/04* (2006.01)
*F26B 3/04* (2006.01)
(Continued)

(52) U.S. Cl.
CPC ..... *F26B 5/044* (2013.01); *F26B 3/04* (2013.01); *F26B 17/04* (2013.01); *F26B 21/10* (2013.01); *F26B 25/22* (2013.01)

(58) Field of Classification Search
CPC .. F26B 5/044; F26B 3/04; F26B 17/04; F26B 21/10; F26B 25/22; F26B 9/06
(Continued)

(56) References Cited

U.S. PATENT DOCUMENTS 2,948,966 A 8/1960 Hanson
4,777,604 A * 10/1988 Robinson ..... F26B 21/10 700/208
(Continued)

FOREIGN PATENT DOCUMENTS

AU 489768 B2 3/1976
CA 2224819 A1 1/1997
(Continued)

OTHER PUBLICATIONS

European Patent Office, "Communication pursuant to Rules 70(2) and 70a(2) EPC", regarding EU App. No. 19830365.3, dated Feb. 7, 2022.
(Continued)

*Primary Examiner* — John P McCormack
(74) *Attorney, Agent, or Firm* — STGIP, LLC; Shawn Gordon

(57) ABSTRACT

A material drying system, method, and control system therefor that provides for consistent and efficient drying of various materials is disclosed. In certain embodiments, a vacuum kiln can use various temperature measurements to reduce the chance of overheating the materials. In certain embodiments, a vacuum kiln (or a control system therefore) can use sensed information, such as the temperature differential across a platen assembly or the duty cycle of a vacuum pump, to determine when a large group of material has reached a substantially uniform dryness level. In certain embodiments, a vacuum kiln as disclosed herein can reduce
(Continued)

checking, splitting, over-drying, and under-drying of material without requiring parameters from a user.

12 Claims, 8 Drawing Sheets

(51) Int. Cl.
*F26B 17/04* (2006.01)
*F26B 21/10* (2006.01)
*F26B 25/22* (2006.01)

(58) Field of Classification Search
USPC ..... 34/210
See application file for complete search history.

(56) References Cited

U.S. PATENT DOCUMENTS

| | | | | |
|---|---|---|---|---|
| 5,433,020 | A | 7/1995 | Leech | |
| 2004/0148795 | A1* | 8/2004 | Bernon | F26B 21/02 34/219 |
| 2012/0101620 | A1* | 4/2012 | Bendiktsen | F26B 21/06 700/109 |

FOREIGN PATENT DOCUMENTS

| | | | | |
|---|---|---|---|---|
| CN | 102288009 | A | 12/2011 | |
| JP | 2015-031486 | A | 2/2016 | |
| WO | 2007130058 | A1 | 11/2007 | |
| WO | WO-2007130058 | A1 * | 11/2007 | F26B 21/06 |

OTHER PUBLICATIONS

European Patent Office, "Extended European Search Report", regarding EU App. No. 19830365.3, dated Feb. 7, 2022.
"Notice of Allowance", regarding Canadian Application No. 3,012,914, dated Apr. 1, 2019.
Mousseau, "Amendment—Response To Examiner's Report", related to Canadian Application No. 3,012,914, dated Jan. 23, 2019.
Novakovic, "Office Action", regarding Canadian Application No. 3,012,914, dated Jan. 29, 2019.
Novakovic, "Office Action", related to Canadian Application No. 3,012,914, dated Oct. 23, 2018.
Thomas, "International Search Report and Written Opinion of the International Searching Authority", regarding International Application No. PCT/US19/40321, dated Jan. 30, 2020.
Thomas, "Invitation to Pay Additional Fees and, Where Applicable, Protest Fee", related to PCT Application No. PCT/US19/40321, dated Oct. 7, 2019.

* cited by examiner

VACUUM DRYING KILNS AND CONTROL SYSTEMS THEREFORE

FIELD OF THE INVENTION

The present invention generally relates to drying kilns. In particular, the present invention is directed to Vacuum Drying Kilns and Control Systems Therefore.

BACKGROUND

Drying of organic materials such as hay, lumber, hemp, cotton, *cannabis*, etc., have been considered, for some time, more art than science. This is largely due to the inherent variability of organic materials. For example, even the same species of trees cut from the same forest can have differing water contents, and drying characteristics, which when dried using traditional methods, can result in wood that has different dryness or poor quality. Moreover, material storage factors (e.g., time of storage, spacing/aeration techniques, storage conditions (covered, enclosed, humidity controlled, etc.)) can impact the water content of the material before the drying process begins. Moreover, the drying process not only reduces the weight of the material, but also impacts other characteristics of the product and reduces the chances of degradation due to excess moisture.

The drying process not only reduces the weight of the material, but also stabilizes the size and finished characteristics of the product and reduces the chances of degradation due to excess moisture. The use of drying kilns is widespread for many materials. For example, drying kilns are used to prepare lumber for use in building furniture, flooring, and other applications where warping of lumber during and after incorporation in the product or structure is not acceptable.

There are differing ways to dry materials, including: steaming, dehumidification, air drying, and kilns. Most of these methods take significant time, effort, and experience to operate so as to produce a desirable result.

Vacuum kilns are a specially designed type of kiln that can reduce drying time from weeks to days and from months to weeks, depending on the type and thickness of the material/lumber to be dried. Various forms of vacuum kiln drying have long been implemented on the premise that the boiling point of water is lowered when the surrounding atmospheric pressure is reduced, thereby reducing the energy required to dry the materials and a reduction of the possibility of excessive heat damaging the materials. However, variations of water content in the materials can result in inconsistent drying from batch to batch or even within the same batch of materials placed in the kiln.

With respect to *cannabis* in particular, it has been used for many hundreds of years to treat a variety of medical conditions. Historically, *cannabis* was known to have a unique ability to counteract pain which is resistant to opioid analgesics. The use of *cannabis* as prescription medicine is being revisited as a way to treat pain, seizure, and many other conditions. In addition to medical uses, *cannabis* can be used therapeutically and recreationally and recent changes in state and national laws have introduced potential new markets for *cannabis*.

The *cannabis* plant, or *cannabis*, contains a number of chemical compounds called cannabinoids that activate cannabinoid receptors on cells that repress neurotransmitter release in the brain. The most well-known cannabinoid is the phytocannabinoid Δ9-tetrahydrocannabinol (THC), which is the primary psychoactive compound of the *cannabis* plant.

At least 85 different cannabinoids may be extracted from the *cannabis* plant, including cannabidiol (CBD), cannabinol (CBN), tetrahydrocannabivarin (THCV), and cannabigerol (CGB).

*Cannabis* is generally cured after harvest, because it cannot otherwise be effectively consumed by traditional methods. *Cannabis* generally contains about 70 to 80 percent water, but drying *cannabis* can result in better storability while retaining potency, taste profiles, and medicinal values and efficacy. However, excess drying and/or drying methods that employ too much or too high a heat will typically evaporate some of the volatile oils that give *cannabis* its unique taste and aroma.

A number of methods to dry *cannabis* exist. The most common of these methods is slow drying. Whole plants or separated colas are dried, generally in a cool dark room or other enclosed space. The *cannabis* material may be hung from a string or from pegs on a wall or laid out on drying screens. Screen drying involves spreading out *cannabis* buds on screens to dry. The screens can be laid out or placed in a dehydrator. Drawbacks to screen drying include extra labor in removing leaves from buds and removing buds from the stems, which can be labor intensive. Moreover, it is believed that with the stem removed, the buds can dry too quickly, making the *cannabis* harsher tasting. Screen drying can also result in uneven drying, because small buds dry more quickly than larger buds.

With a drying line, colas, branches, or entire plants may be hung upside down from wire or rope lines running from wall to wall. This makes a convenient temporary hanging system, but as the bud dries, the water in the stem slowly wicks into the bud, which slows down the drying process. The slower drying process can result in a smoother taste than drying screens. Another method of slow drying is cage drying. Buds can be hung from wire cages. Because the cages can be picked up and moved, they can easily be moved closer or further from heaters, fans, and dehumidifiers as needed to ensure even drying.

Methods of speeding up the drying process include the use of fans, which decrease the chance of mold and speed along the drying process, heaters, which drive down the humidity levels and speed up the drying process (and also reduce mold), and dehumidifiers. Fast drying can produce a harsher end product than slow drying. In addition, it is believed in the industry that fast drying can not only damage cannabinoids, terpenes, and flavonoids, but can also prevent the plant from reaching peak potency during the cure phase because of locked in chlorophyll.

In industrial applications, current producers of *cannabis* are generally using dehumidification alone to dry the *cannabis*, where dehumidifiers are run at full strength until the *cannabis* materials are adequately dry, without consideration as to drying time, rate, or other potential issues that would impact the materials.

Thus, there exists a need for a time, cost, and energy effective device and control system for drying materials, wherein such a device and control system are capable of increasing yield (reducing loss due to degradation).

SUMMARY OF THE DISCLOSURE

In a first aspect, a drying process for drying materials containing water is disclosed, the drying process comprising: providing a container and a heating system, the heating system for heating the materials placed within the container, wherein the heating system is sized and configured to provide a fixed, maximum heat output, wherein the fixed, maximum heat output does not substantially exceed an amount of energy necessary to overcome the latent heat of vaporization once the water inside the material has started to boil; creating a vacuum within the container; heating the materials to an initial temperature such that water, contained within the material, begins to boil; increasing the heat output of the heating system to the fixed, maximum heat output; continuously maintaining the fixed, maximum heat output throughout a free water phase and an equalization phase of the drying process.

In another aspect, a drying control system for a vacuum based drying system for drying a material in a vacuum chamber is disclosed, the drying control system comprising: a heat control device; a plurality of first sensors in communication with the heat control device, each of the plurality of first sensors capable of sending a signal, representative of a temperature of a fluid used to heat the material, to the heat control device; and a plurality of second sensors in communication with the heat control device, each of the plurality of second sensors capable of sending a signal, representative of a temperature of the inside of the material, wherein the heat control device controls a rate of evaporation of moisture from the material by adjusting the temperature of the fluid based upon a temperature difference, the temperature difference being determined by comparing a difference to the signals from the plurality of second sensors, the difference being determined from the plurality of first sensors.

In yet another aspect, a vacuum drying system for drying a material in need thereof is disclosed, the vacuum drying system comprising: a vacuum chamber sized and configured to receive the material; a heating system coupled to the vacuum chamber and configured to transfer heat to the material, the heating system having an inlet temperature and an outlet temperature; a plurality of temperature probes coupled to the material, each of the temperature probes measuring an internal temperature of the material; and a drying control system comprising: a heat control device; a first sensor in communication with the heat control device, the first sensor capable of sending a signal, representative of a temperature of a fluid used to heat the material, to the heat control device; and a second sensor in communication with the heat control device, the second sensor capable of sending a signal, representative of a temperature of the inside of the material, wherein the heat control device controls a rate of evaporation of moisture from the material by adjusting the temperature of the fluid based upon a temperature difference, the temperature difference being determined by comparing the signal from the first sensors and the signal form the second sensor.

In a further aspect, a drying control system for use with a vacuum based drying system for drying materials, the vacuum based drying system including a vacuum chamber, a heating system having an inlet and an outlet, and a plurality of temperature probes coupled to the material is disclosed, the drying control system comprising: a heat control device including a processor, the processor including a set of instructions for adjusting the temperature of a fluid provided to the vacuum chamber, the instructions comprising: increasing the temperature of the fluid when a temperature difference is less than a predetermined amount; when the moisture in the material begins to boil, maintain the fluid at a first constant temperature; when the temperature of the material and the temperature of the fluid entering the vacuum chamber are approximately equal, increasing the temperature of the fluid; and when the material is at the fiber saturation point, maintaining the temperature of the fluid at a second constant fluid temperature.

BRIEF DESCRIPTION OF THE DRAWINGS

For the purpose of illustrating the invention, the drawings show aspects of one or more embodiments of the invention. However, it should be understood that the present invention is not limited to the precise arrangements and instrumentalities shown in the drawings, wherein.

DESCRIPTION OF THE DISCLOSURE

Figure 1:
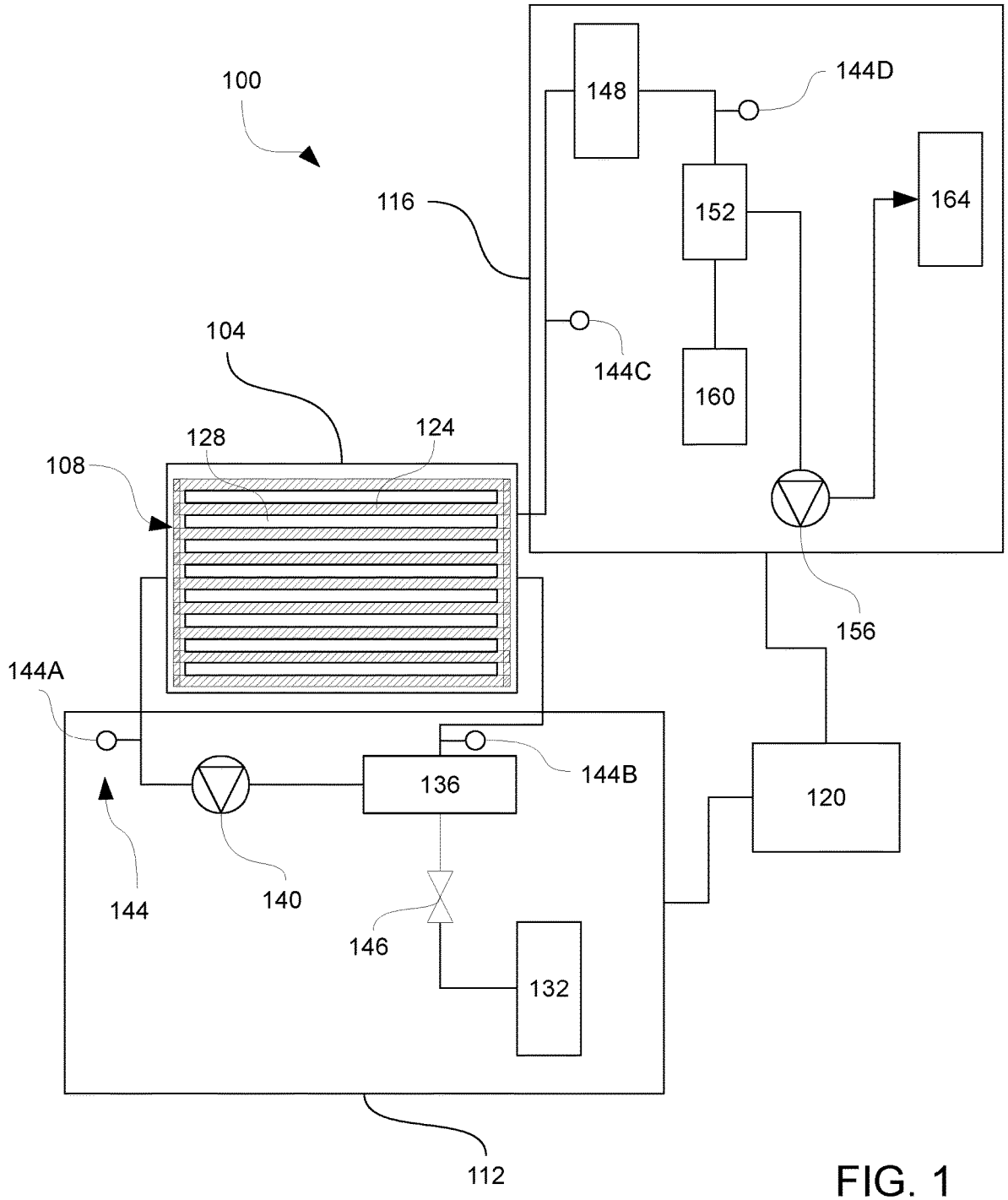
FIG. 1 is a cut-away schematic of a vacuum kiln system according to an embodiment of the present disclosure.

A vacuum kiln according to the present disclosure provides for consistent and efficient drying of various materials, such as, but not limited to, wood, *cannabis*, organic materials, and foam. In certain embodiments, the vacuum kiln can use various temperature measurements to reduce the chance of overheating/over-drying the materials. In certain embodiments, a vacuum kiln can use sensed information, such as the temperature differential across a platen assembly, energy used by the platen assembly (when, for example, using resistance heating elements) or the duty cycle of a vacuum pump, to determine when a large group of material has reached a substantially uniform dryness level. In certain embodiments, a vacuum kiln, as disclosed herein, can reduce checking, splitting, over-drying, and under-drying of material without requiring parameters from a user.

A general description of the operation of a vacuum kiln will now be provided. For the purposes of this description, the material is lumber—many other materials in need of drying may be placed into the kiln with variations that would be understood by a person of ordinary skill in the art based upon this disclosure. Typically, in a vacuum kiln, layers of lumber are either stacked on stickers as in the dehumidification kiln, or on hot plates or platens separating the layers of wood until the desired stack is obtained. The platens are typically large, flat hollow structures through which hot water is circulated by means of a hot water supply and conduits to and from the platens. In some vacuum kilns, heated air is circulated around the materials, which may be separated by plates, lattices, or otherwise disposed so as to facilitate circulation. Temperatures inside these kilns are similar to those reached in conventional dehumidification kilns. An airtight container capable of handling significant vacuum houses the lumber during the drying process. Also, the container must be constructed of an inert material such as stainless steel, due to the corrosive nature of the acids which are removed from the wood during the drying process.

After the stack of lumber has been placed inside the kiln container and the door sealed, the drying process may begin. A partial vacuum is created in the container by means of a vacuum pump connected with the interior of the kiln container and exhausting to the outside. As the vacuum increases, the moisture in the lumber is boiled out of the lumber at temperatures below the boiling point of water (if the vacuum is sufficiently high, the water will boil at room temperature). The steam or water vapor released by the lumber inside the container is passed through a condenser and then pumped to the outside of the container. As the moisture inside the lumber boils and is released, the temperature of the lumber drops. This is due to the fact that latent energy in the moisture within the wood turns to steam and leaves the wood. To compensate for this loss in energy, heat must be added to the container to prevent freezing of the wood or the slowing of the drying process. When platens are employed, direct heating by contact with the layers of lumber is accomplished through the intervening platens.

Referring now to FIG. 1, there is shown an exemplary vacuum kiln system 100 useful for drying a variety of materials, according to an embodiment of the present disclosure. Vacuum kiln system 100 includes a sealable container 104 with a removable platen assembly 108. Platen assembly 108 is fluidly coupled to a heating system 112, which in certain embodiments, directs water through the platen assembly so as to heat up materials contained within container 104. Container 104 is also coupled to a depressurization system 116, which reduces the pressure within the container so as to assist with the evaporation of moisture of the materials contained within. In another embodiment, platen assembly 108 is a plurality of electrically heated plates or plates with internal electrical resistance heating elements. Heating system 112 and depressurization system 116 are each in communication with a control system 120, which receives information from one or more sensors (discussed below) so as to direct the operation of heating system 112 and depressurization system 116.

Platen assembly 108 includes plurality of platens 124 which are selectively positioned in between stacked layers of material 128. In an embodiment, platen assembly 108 includes a plurality of square or rectangular platens 124 that are fillable with a fluid, such as water, or are heated using resistance heating elements disposed within the platens. Typically, the size and configuration of each platen 124 is similar in area to the layer of material so as to provide for even heat distribution to all areas of the material. Each platen may also include on its top or bottom surface a number of separators that prevent the platen from crushing material 128. Separators may be sized and configured on platens 124 so as to provide for substantially uniform heating of materials 128 without damaging the materials. Each of platens 124 are connected on an inlet side via tubes (not shown) and/or an input manifold (not shown) and rejoined at an exit side via tubes (not shown) and/or an exit manifold (not shown) when the platens are filled with a fluid so as to facilitate fluid transfer.

In another embodiment, material 128 is distributed on a metal belt conveyor heated by surrounding induction heaters. The use of the conveyor allows for the rotation of materials and may allow for more uniform heating of the materials (especially if the materials are non-uniform). In this embodiment, heat is transferred to materials 128 and the conveyor by an induction heat source.

In another embodiment, material 128 is hung inside container 104 on strings, from prebuilt pegs configured to hold the material, or laid out on drying screens or perforated platens. In this embodiment, heating system 112 may be configured as a forced air heating system, thereby circulating warm air throughout container 104.

Heating system 112 is sized and configured to provide heat to container 104 and consequently to a material 128 so as to facilitate evaporation of fluids in the material. In an embodiment, heating system 112 includes a boiler 132, heat exchanger 136, a pump 140, and one or more thermocouples 144 (e.g., thermocouples 144A and 144B). In an exemplary embodiment, boiler 132 is a steam boiler that is fluidly coupled to heat exchanger 136. Heat exchanger 136 receives a heated fluid from boiler 132 and transfers the heat in the fluid to the fluid that enters and exits platen assembly 108. Heat exchanger 136 can be a shell-and-tube, plate/fin, or any other type of heat exchanger suitable to transfer heat from boiler 132 to platen assembly 108. Generally, for shell and tube heat exchangers, one fluid flows through a set of metal tubes while a second fluid passes through a sealed shell that surrounds the metal tubes. Plate/fin heat exchangers include a plurality of thin metal plates or fins, which results in a large surface area for transferring heat.

Figure 2:
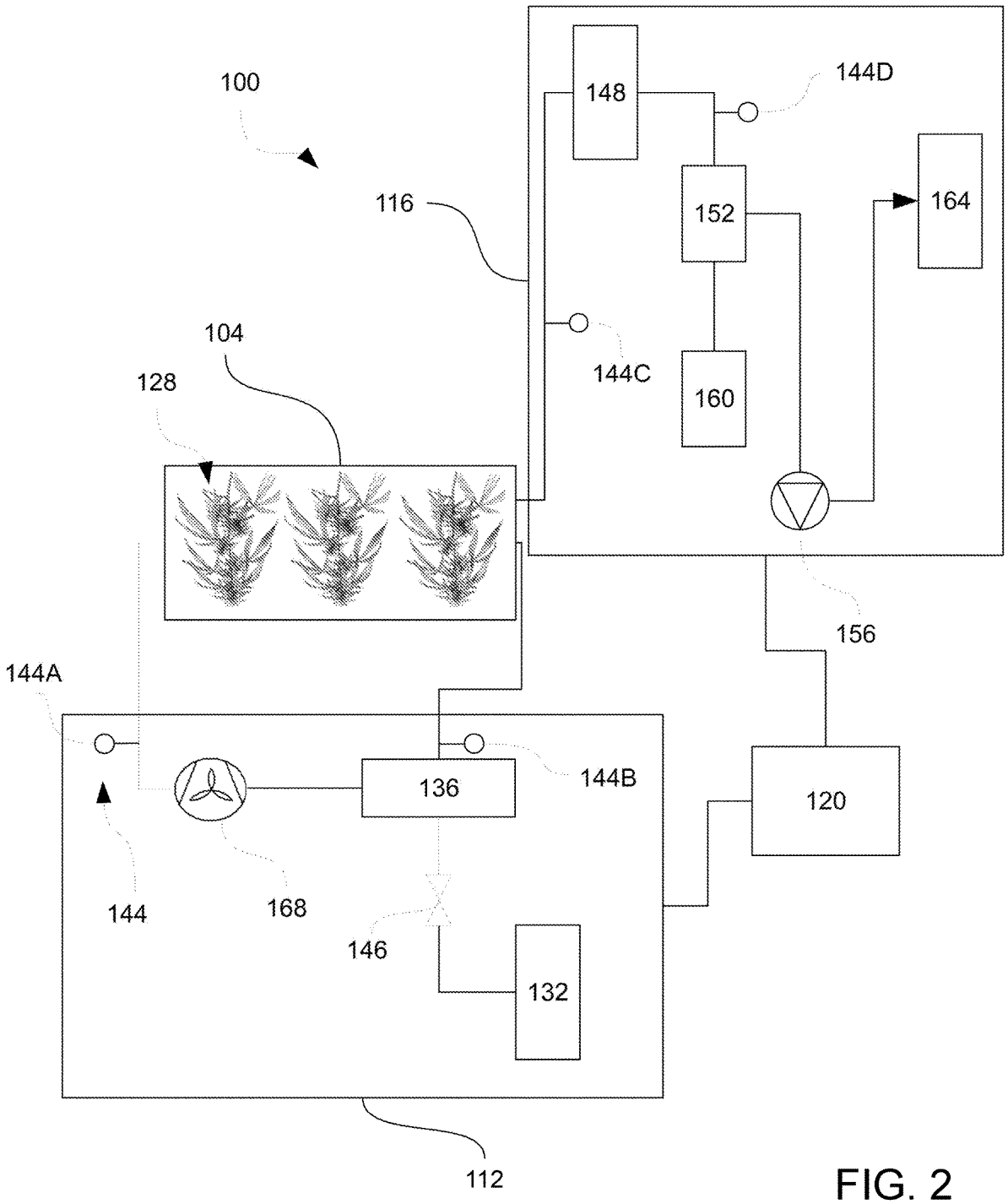
FIG. 2 is another cut-away schematic of a vacuum kiln system according to an embodiment of the present disclosure

In another embodiment of heating system 112, and as shown in FIG. 2, heating system 112 is a hot air assembly that delivers hot air within container 104. Hot air may be directed by fans 168 through perforated platens, screens, or around hanging materials 128.

In yet another embodiment of heating system 112, the heating system is sized and configured so as to deliver a predetermined heat output (BTUs) to raise the temperature of material 128 (and the water contained therein) at a fixed rate until it reaches the evaporation temperature (vapor pressure) and to maintain the temperature of the material (and water) in the necessary range of temperature for evaporation (boiling) to occur but not any higher. It should be recognized that the vapor pressure is not dependent upon the type of material, material dimensions, or the moisture content of the material—the vapor pressure at boiling is, in this situation, dependent upon the vacuum inside container 104. In this embodiment, heating system 112 is sized to sufficiently raise the temperature of the material (and water contained therein) to boiling but not to raise the temperature of the material and water past the boiling point due to the extra energy required for the latent heat of evaporation.

After evaporation has occurred for a duration, e.g., hours, days, weeks, (the duration depends on, among other things, the material type, material thickness, and the moisture content) the amount of water removed from the material is such that the heating energy from heating system 112 is no longer needed to overcome the latent heat of evaporation and therefore the temperature of the material 128 will raise to a predetermined final drying temperature set point. Upon reaching the set point, heating system 112 can cycle off and on to maintain the set point. The set point is a temperature, at the given vacuum, where there is a certain material moisture content. Once the set point has been achieved, material 128 can be removed from container 104.

One of the several advantages of this embodiment of heating system 112 is that it offers very simple control over the evaporation process as there is no need for sensor feedback regarding drying rates. Sizing heating system 112 appropriately is enough to achieve the correct drying rate and to achieve the desired moisture content.

An example of the use of a heating system 112 as just discussed is now described. In this example, a load of wood having an initial moisture content of 70% (meaning that 70% of the dry weight of the wood is water). Given the mass of wood, there is approximately 1,000 lbs. of water to be evaporated. At a predetermined vacuum, it will initially take 12 kw of heat energy to raise the temperature of the water, wood and kiln to the boiling point without significantly exceeding the boiling point. As the water in the wood evaporates, the temperature of the wood decreases due to the latent heat of evaporation. In response, the output of heating system 112 is increased to 30 kw so as to raise the temperature of the wood, water and kiln to the boiling point and to keep the temperature at the temperature required to boil water at the given vacuum, but no higher because of the extra 1,000 BTUs/lbs. of water evaporated it takes to overcome the latent heat of evaporation.

Thus, despite the wood being subject to constant heating, the temperature of the wood does not exceed the boiling point of water at the vacuum in the container, thereby reducing material degradation issues due to overheating or heating too fast.

Once the bulk of the free water evaporates (free water is discussed in more below with reference to FIGS. 5 and 7), the bound water will take longer to migrate from the cell walls inside the wood to the exterior where it can be evaporated, thus the rate of water diffusion is lower and concomitantly, the rate of evaporation is lower. Accordingly, given a constant heat input, the temperature of the material increases, which promotes circulation and delusion of water in the wood and increases the rate water moved from the inside of the wood to the exterior to be evaporated. This increased rate of evaporation now holds the higher temperature constant due to the increased latent heat of evaporation.

At a vacuum of 8 inHgA and a temperature of 160° F., the equilibrium moisture content of the wood is about 6%. Accordingly, once the material reaches the high temperature set point the wood is close to 6% moisture content and can evaporate no more moisture because it is in equilibrium with the surrounding environment. Thus, after some time at a vacuum of 8 inHgA and 160° F. we can say the wood has equalized and is finished drying.

Returning to FIG. 1, pump 140 is a fluid pump capable of moving a fluid, typically water, through the platen assembly 108. The temperature of the fluid going to or coming from platen assembly 108 is measured by thermocouples 144A and 144B, respectively. Thermocouples 144 can be most any type of thermocouple that is capable of measuring fluid temperatures that are typically below 200° Fahrenheit. As explained in more detail below, thermocouples 144 are coupled to control system 120, which uses the signals generated by the thermocouples, and other information, to control the heat coming from boiler 132 (typically via valve 146).

Depressurization system 116 creates a partial vacuum in container 104 so as to lower the atmospheric pressure within the container and thereby facilitate evaporation of fluids from material 128. In an embodiment, depressurization system 116 includes a condenser 148, a first separator 152, a vacuum pump 156, a condensate drain tank 160, a second separator 164, and additional thermocouples 144 (thermocouples 144C and 144D).

Condenser 148 removes liquids (namely, water) from air pulled from container 104. As the primary purpose of vacuum kiln system 100 is to dry material 128, the liquid removed from the materials is desirably evacuated so as to lower the humidity in container 104. In an embodiment, condenser 148 is an air-cooled condenser whereby air from container 104 is drawn into a plurality of tubes or plates while a fan moves external air across the tubes or plates. This process causes the air inside the tubes or plates to cool, which precipitates liquids that can be removed by separator 152. Other types of condensers can be used, such as, but not limited to, water cooled condensers or evaporative condensers.

Separator 152 is fluidly coupled to condenser 148 and serves to remove condensate generated by condenser 148. Condensate separators come in a variety of types such as, but not limited to, chemical adsorption separators, gravitational separators, mechanical separators, and vaporization separators. In an exemplary embodiment, separator 152 is a gravitational separator that allows the condensate to flow to condensate drain tank 160. In operation, the condensate stream from condenser 148 is passed into a large space, which decreases the transfer speed thereby allowing the liquid particles in the stream to sink from the condensate stream.

Vacuum pump 156 is sized and configured to create a partial vacuum in container 104. In an exemplary embodiment, vacuum pump 156 is sized and configured to lower the atmospheric pressure in the container between about 0.5 in Hg Absolute and 0.10 in Hg Absolute. In an embodiment, vacuum pump 156 is a liquid ring pump or rotary vane pump, which compresses gas by rotating an impeller disposed within a cylindrical casing. A fluid (usually water) is fed into the vacuum pump and, by centrifugal acceleration, forms a moving cylindrical ring against the inside of the casing, thereby creating seals in the space between the impeller vanes, which form compression chambers. Air from container 104 is drawn into vacuum pump 156 through an inlet port in the end of the casing, and then is trapped in the compression chambers formed by the impeller vanes and the liquid ring and exits through a discharge port.

Air leaving vacuum pump 156 is sent to second separator 164, which separates liquids from the air. Separated liquid is returned for use in vacuum pump 156. In an embodiment, second separator 164 is a gravitational separator that passes the air leaving vacuum pump 156 into a large space, which decreases the transfer speed thereby allowing the liquid particles in the air to be separated.

Control system 120 is configured to adjust the depressurization of chamber 104 and the temperature of the fluid going through platen assembly 108 in response to the real-time evaporation conditions of the fluid in material 128. In an embodiment, control system 120 is in communication with components of heating system 112 and depressurization system 116 so as to control the rate of evaporation from material 128.

Figure 3:
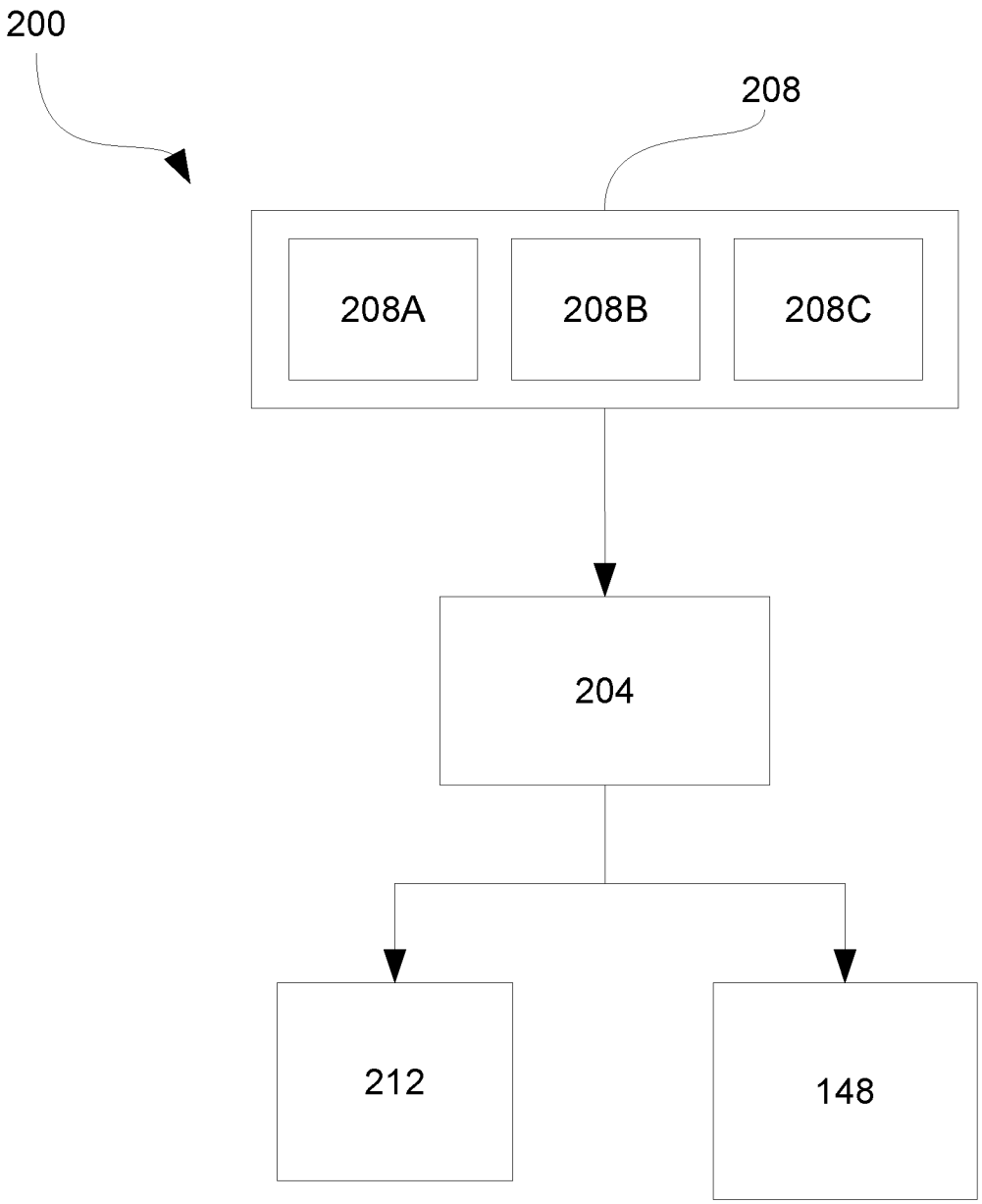
FIG. 3 is a block diagram of an exemplary control system according to an embodiment of the present disclosure.

An embodiment of a control system suitable for use with vacuum kiln system 100 is shown in FIG. 3 as control system 200. Control system 200 includes a programmable logic controller (PLC) 204, which as shown, receives inputs from many different sensors, and sends commands to others components, based upon the inputs and the various software routines run by the PLC 204. These routines can be integrated with each other, as well as be discrete modules which operate on their own, or a combination of both.

As shown, PLC 204 is in electronic communication with a plurality of sensors 208. For example, sensors 208 can be temperature sensors 208A that provide a signal, indicative of a temperature, of:

- the fluid entering platen assembly 108;
- the fluid exiting platen assembly 108;
- the air exiting container 104;
- the air exiting condenser 148; and
- the material 128.

In a preferred embodiment, at least one temperature sensor is inserted into a portion of material 128 such that moisture cannot escape around the temperature sensor. The desired result is that the measured internal temperature of the material 128 is effectively the wet-bulb temperature, which is the lowest temperature that can be reached under current ambient conditions by the evaporation of water only.

Having temperature sensors 208A inside material 128 (and preferably multiple ones at different locations throughout the materials), and at different locations related to heat inputs and outputs (such as at the heating fluid entrance to platen assembly 108 and at the heating fluid exit of the platen assembly), and optionally, before and after condenser 148, allows for determinations regarding the state of evaporation of water from the material. It should be noted that humidity sensors can be used in addition to or in certain embodiments substituted for temperature sensors 208A.

Sensors 208 can also provide information related to the duty cycle of vacuum pump 156 by indicating when the vacuum pump is being used or when it is off. For example, a duty cycle sensor 208B, which can be a frequency monitor, can send a signal representative of the power usage by vacuum pump 156 to PLC 204.

Sensors 208 can also provide information related to the vacuum in container 104. Sensors 208 suitable for measuring the vacuum can include, for example, pressure transmitters and pressure transducers. In an embodiment, at least one pressure sensor 208C is in electronic communication with PLC 204, the pressure sensor sending a signal representative of a pressure inside container 104.

Inputs from sensors 208 can then be used to regulate a control valve 212 that is disposed between boiler 132 and heat exchanger 136, thereby controlling the temperature of the fluid going to platen assembly 108. Input from sensors 208 can also be used to increase/decrease the air flow through condenser 148 so as to ensure efficient operation of the equipment and vacuum pump 156.

PLC 204 can also monitor power consumption so as to determine the rate of evaporation occurring within container 104. For example, receiving information from sensor 208B can indicate how often vacuum pump 156 is being actuated to maintain the desired pressure within container 104. It should be noted that the pressure within container 104 changes in response to evaporation from material 128 (gases have larger volumes than liquids). As such, sensor 208B can provide an indication of the power usage/duty cycle of vacuum pump 156.

While PLC 204 is shown as part of control system 120, it is understood that multiple PLCs can be employed and can contain software written to both act upon input signals obtained from other sensors or other components and ensure that the various components operate together.

In a preferred embodiment, PLC 204 is configured so as to efficiently and effectively control the evaporation of moisture from material 128. Efficient and effective evaporation occurs, in an embodiment, by monitoring the temperature of material 128 (or a representative sample of the material) and adjusting the input temperature of the fluid going to platen assembly 108. In a preferred embodiment, the difference between the temperature of material 128 and the input temperature of the fluid entering platen assembly 108 is kept below about 7 degrees Fahrenheit.

Figure 4:
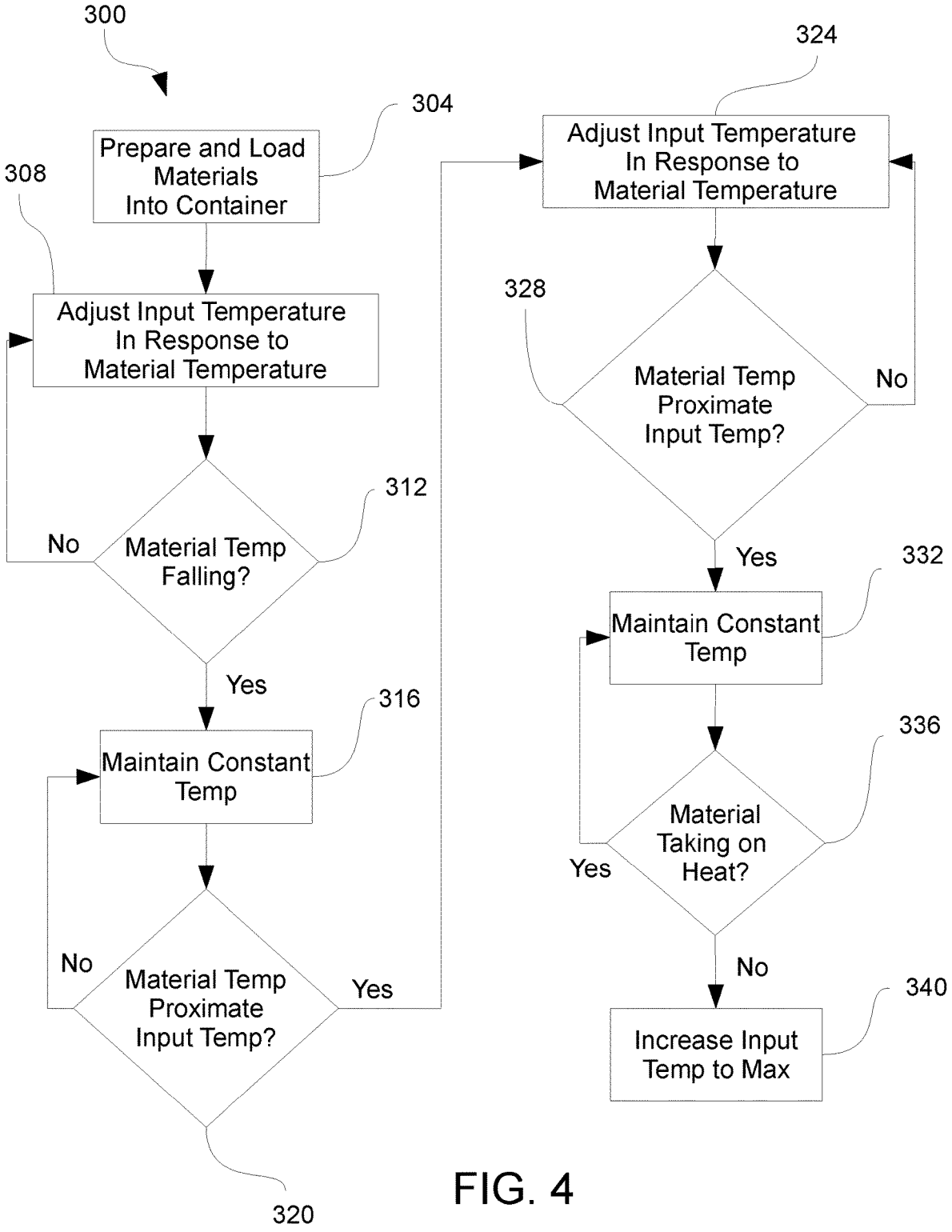
FIG. 4 is a process diagram of an exemplary process of drying materials using a vacuum kiln according to an embodiment of the present invention.
Figure 5:
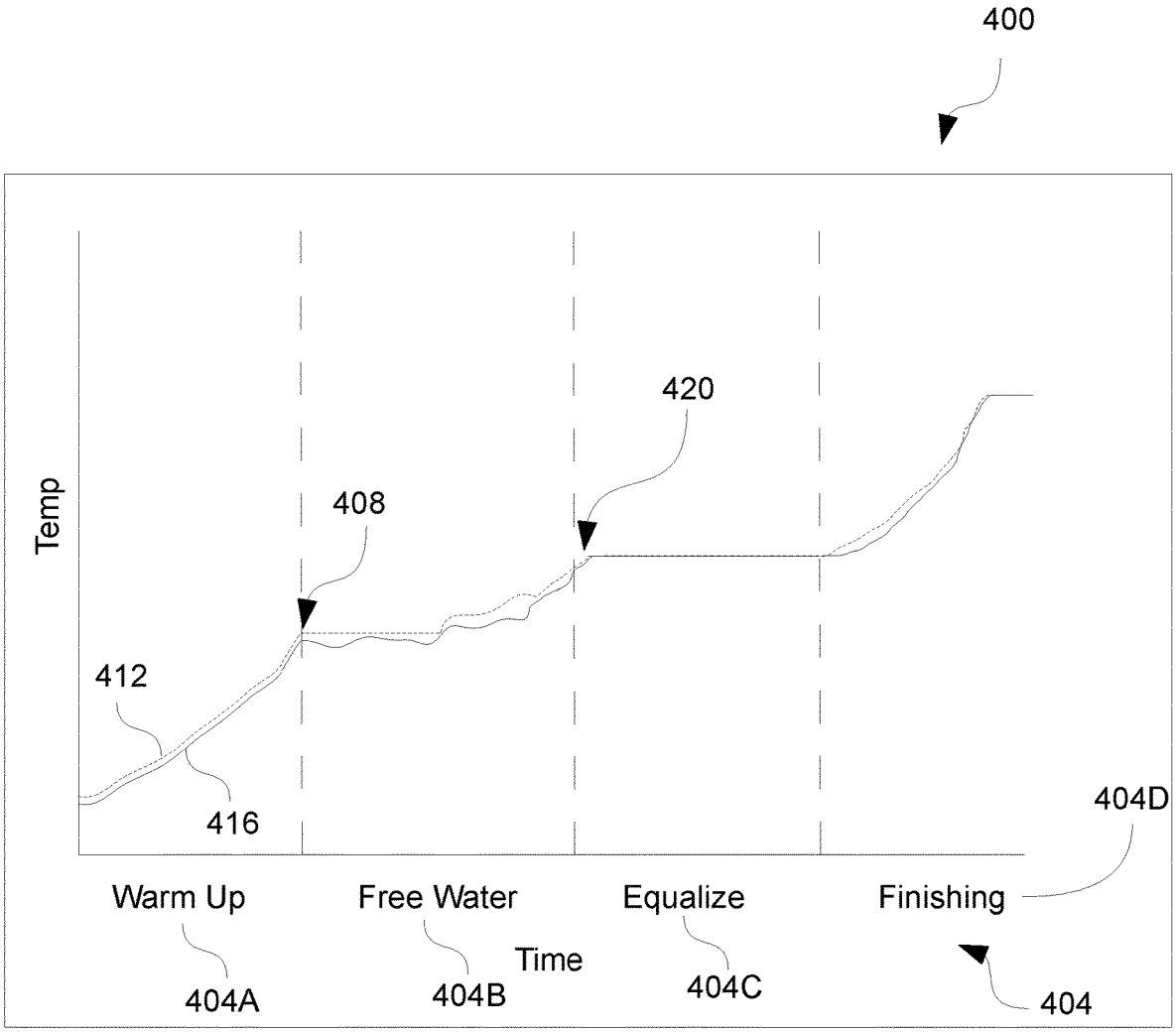
FIG. 5 is a chart of a drying process according to an embodiment of the present invention.

Turning now to FIGS. 4 and 5, there is shown a process 300 suitable for operating a vacuum kiln system, such as vacuum kiln system 100, so as to achieve consistent and efficient drying of material 128, and a chart 400 of heat input and material temperature over time, which is reflective of the results of process 300. Process 300 can be characterized as having 4 phases, shown as phases 404A-D in FIG. 5: a warm up phase 404A, a free water phase 404B, an equalization phase 404C, and a finishing phase 404D. It should be noted that the division into the phases 404 is used for illustrative purposes only and more or fewer phases could be described and still come within the scope of process 400.

Prior to warm up phase 404A, material 128 is loaded into container 104 at step 304. In an exemplary embodiment, layers of material 128 are separated by platens 124. One or more temperature sensors 208A are coupled to material 128 (before or after loading). In an embodiment, at least four temperature sensors 208A are inserted into various portions of material 128.

The initial temperature of material 128 can vary depending on the storage conditions, but under any reasonable storage conditions the materials will be cooler than is desired in order to cause significant evaporation. In an embodiment, during warm up phase 404A, the pressure in the container is reduced using vacuum pump 156 and the temperature of material 128 is brought to a desired evaporation temperature 408 gradually using heating system 112 to avoid stressing the materials (for example, excessive evaporation could cause unequal drying thereby causing case hardening and trapping water in the plant, thereby resulting in evaporation of components of the materials that should not be evaporated, e.g., oils.). As is known in the art, the temperature of evaporation (i.e., rapid transfer of liquid to the gaseous phase), is dependent upon pressure. Thus, the larger the vacuum the lower the temperature that is required to promote evaporation.

As shown in FIG. 5, input temperature 412 is the input temperature coming from heat exchanger 136 and material temperature 416 is the average temperature of material 128. At step 308, the input temperature is kept within a certain temperature range of the average temperature of material 128. In an embodiment, the desired temperature difference between the input temperature and the average temperature of material 128 is between about 1° F. and about 10° F. In an embodiment, the input temperature to platen assembly 108 is increased by a predetermined amount once the difference between the input temperature and the average temperature of material 128 reaches a predetermined threshold. For example, the input temperature can be increased by 1° F. once the difference between the input temperature and the average temperature of material 128 is 1° F. As another example, the input temperature can be increased by 1° F. once the difference between the input temperature and the average temperature of material 128 is less than 1° F.

As shown in FIG. 5, during warm up phase 404A, the average temperature of material 128 and the input temperature track each other fairly closely. This is largely due to the lack of evaporation occurring during warm up phase 404A (some is occurring, just as materials left out in the open will generally dry, but not at a significant rate). However, at a certain point, moisture will begin to be released from material 128 at a desired rate.

In certain embodiments, and as mentioned previously, by inserting temperature sensors inside material 128, a seal may be created. As material 128 begins to release moisture, fluid may begin to collect or gather the hole around the temperature sensor. Although it should be understood the that actual material temperature may not have changed, the release of moisture lowers the temperature measured by the sensor (referred to as evaporative cooling), thus lowering the average temperature value received by PLC 204. Process 300 monitors for the aforementioned change at step 312. At this point, the process shifts to the next phase, free water phase 404B.

Before discussing free water phase 404B, it is worth noting the duration of warm up phase 404A may vary according to a number of factors including, but not limited to: material 128's starting temperature, type of material, water content in the material, amount of vacuum applied, input temperature difference maintained, and amount of material in the container. It is also worth noting that it is because of all these possible variables that prior art vacuum kiln systems have failed to repeatably and effectively dry materials without damaging the materials, either by under-drying the materials, or over-drying the materials.

As shown in FIG. 5, material temperature 416 drops fairly precipitously once evaporation begins at the beginning of free water phase 404B. In an embodiment, process 300, at step 316, maintains a constant input temperature for a certain period of time. In this embodiment, the average temperature of material 128 is monitored and only when the average temperature of the materials approaches the constant input temperature (at step 320) does input temperature again begin to be increased at step 324. As with warm up phase 404A, the input temperature can be adjusted in accordance with the average temperature of material 128.

In an alternative embodiment, the process can be configured so as to continue to have the input temperature maintain a desired temperature difference from the average temperature of material 128 throughout the entirety of free water phase 404B. The potential issue with this process is that allowing material 128 to cool can result in a decrease in the amount of evaporation due to changes in hardening material on its surface that can restrict the flow of fluids out of it.

Free water phase 404B continues until the steady convergence of the input temperature and the average material temperature begin to track each other closely (region designated by 420, monitored at step 328), i.e., increases in the input temperature result in concomitant, albeit slightly delayed, increases in the average material temperature. At this point it can be presumed that the fluid entrained in the material that is exterior to the cells of the structure (also referred to in the art as the "free water" in the material) has been substantially released (typically called the fiber saturation point, which is generally when the material has about 30% fluid).

Process 300 then proceeds to equalization phase 404C. During equalization phase 404C, the input temperature is maintained at a constant temperature (step 332) for a predetermined amount of time. As noted above, generally only certain portions of material 128 have a temperature sensor inserted. Thus, while the temperature sensor gives a temperature proximate the area of the material in which it resides, material 128 may have variations in dryness. Equalization phase 404C allows for the entire mass of material to come to the same dryness. In an embodiment, the input temperature is maintained at a constant temperature for a period of several minutes to several hours. In another embodiment or additionally to maintain a constant temperature for a predetermined amount of time, the input temperature can be maintained until the inlet temperature and the temperature at the outlet of platen assembly 108 or the wattage required to maintain set point is reduced. This convergence of temperatures is an indicator that material 128 is taking on no new heat and thus it can be presumed that all of material 128 is approximately at the same dryness. In another embodiment or additionally to maintain a constant temperature for a predetermined amount of time, the duty cycle of vacuum pump 156 is evaluated and used to determine whether material 128 has all reached the same dryness. Duty cycle can be used as a proxy because as less evaporation takes place, the less vacuum pump 156 needs to be turned on in order to keep a constant vacuum. In this way, the duty cycle is a proxy for the rate of evaporation occurring within container 104. In another embodiment or additionally to maintain a constant temperature for a predetermined amount of time, the air inlet temperature and the air outlet temperature proximate condenser 148 are monitored. The closer these two temperatures are to each other, the more likely that no new moisture is being release from material 128.

Process 300 then proceeds to finishing phase 404D. At step 336, the inlet temperature is increased, typically gradually, up to a maximum temperature (at step 340). In an embodiment, the inlet temperature is increased similarly as it was during warm up phase 404D. In an embodiment, the maximum temperature is between about 60° F. and 100° F. In another embodiment, the maximum temperature is dependent upon the vacuum applied. In another exemplary embodiment, the maximum temperature is about 100° F. at 8 in Hg Absolute (inHgA).

Figure 6:
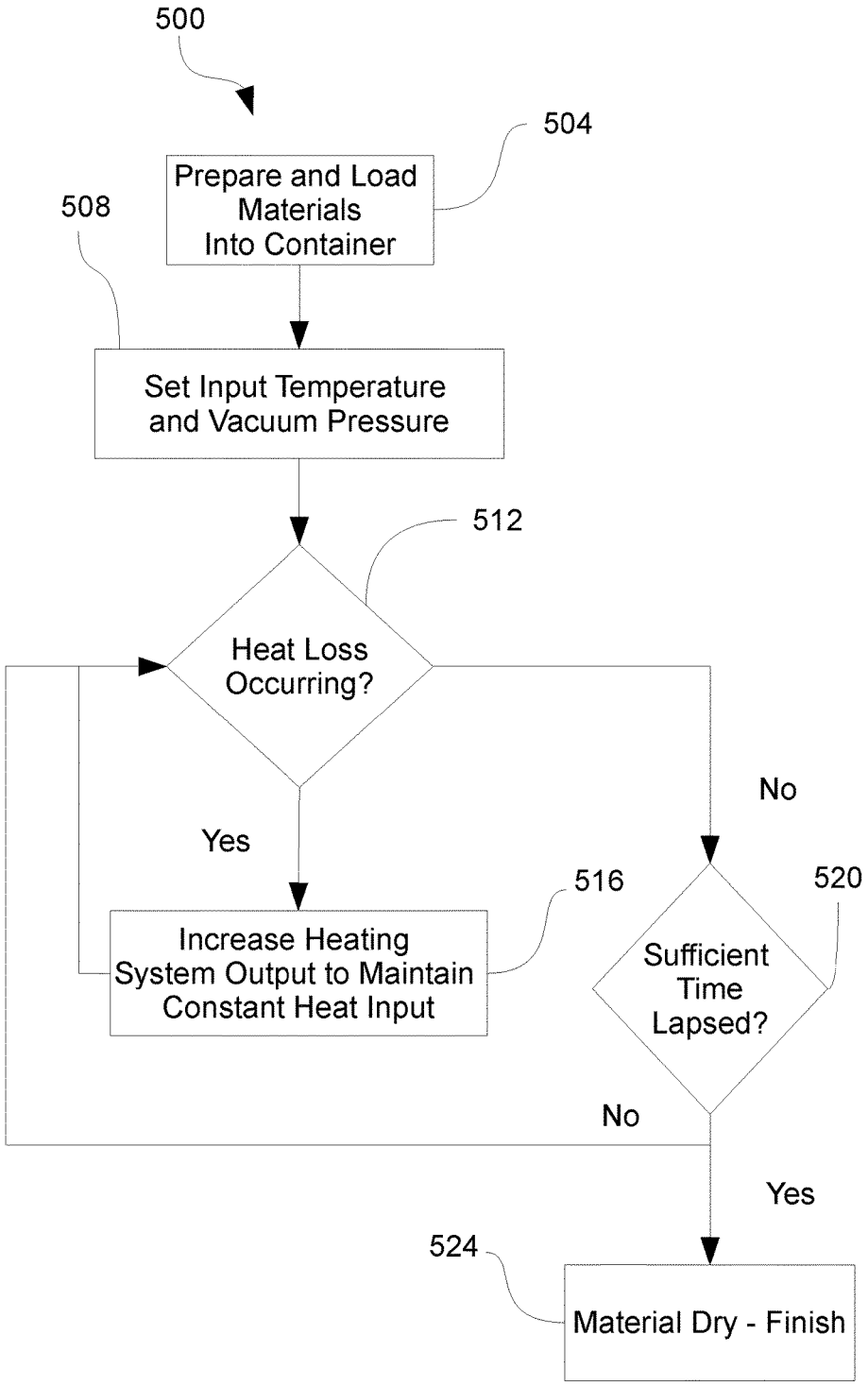
FIG. 6 is a process diagram of another exemplary process of drying materials using a vacuum kiln according to an embodiment of the present invention.
Figure 7:
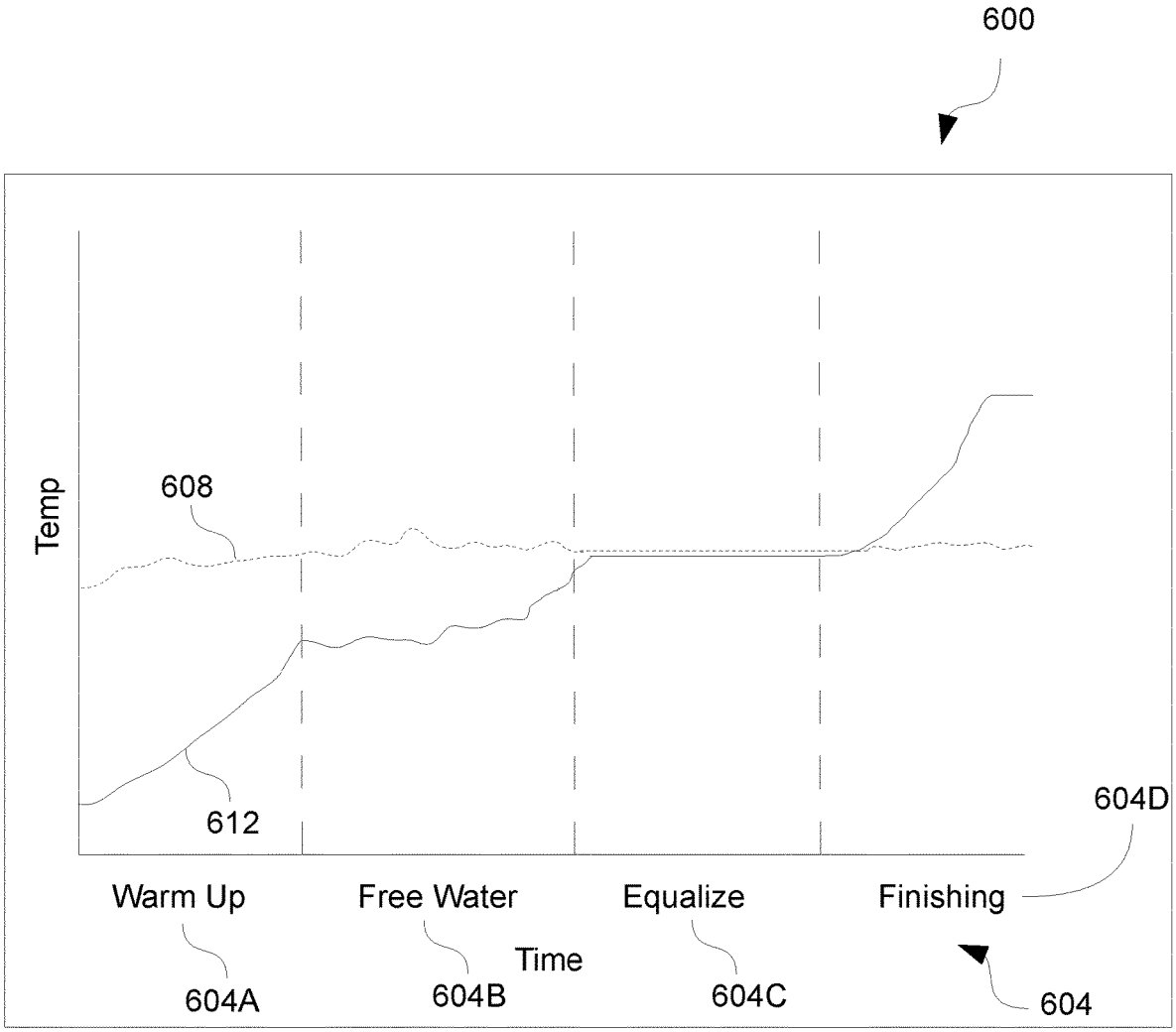
FIG. 7 is a chart of a drying process according to an embodiment of the present invention.

Turning now to FIGS. 6 and 7, there is shown a process 500 suitable for operating a vacuum kiln system, such as vacuum kiln system 100, so as to achieve consistent and efficient drying of material 128, and a chart 600 of heat input and material temperature over time, which is reflective of the results of process 500. Similar to process 300 discussed above, process 500 can be characterized as having 4 phases, shown as phases 604A-D in FIG. 7: a warm up phase 604A, a free water phase 604B, an equalization phase 604C, and a finishing phase 604D. It should be noted that the division into the phases 604 is used for illustrative purposes only and more or fewer phases could be described and still come within the scope of process 500.

Prior to warm up phase 604A, material 128 is loaded into container 104 at step 504. In an exemplary embodiment, layers of material 128 are separated by platens 124. In another embodiment, material 128 is hung throughout container 104. In another embodiment, layers of material 128 are separated by platens that includes spacers so as to not crush the material.

At step 508, an initial input temperature and a vacuum pressure are set. The initial temperature of material 128 can vary depending on the storage conditions, but under any reasonable storage conditions the materials will be cooler than would be necessary cause significant evaporation. In an embodiment, at step 508 the pressure in the container is reduced using vacuum pump 156 and the heating system 112 is set to a desired temperature that is sufficient to release moisture from the materials, but not so warm as to stress the materials (for example, excessive evaporation could cause unequal drying thereby causing case hardening and trapping water in the plant and/or resulting in evaporation of components of the materials that should not be evaporated, e.g., oils.). As is known in the art, the temperature of evaporation (i.e., rapid transfer of liquid to the gaseous phase), is dependent upon pressure. Thus, the larger the vacuum the lower the temperature that is required to promote evaporation.

As shown in FIG. 7, input temperature 608 is the input temperature coming from heat exchanger 136 and material temperature 612 is the average temperature of material 128. Input temperature 608 is shown as varying slightly as the temperature of the platen or in the air is absorbed by material 128, thus resulting in the need for more heat output by heating system 112 to maintain the desired temperature. Thus, while FIG. 7 shows variation in input temperature 608, the variation is due to the reaction of heating system 112 to maintain a constant temperature. In general, the sizing of heating system 112 impacts how quickly it can respond to the need for increased output. In a preferred embodiment, heating system 112 is sized such that the maximum heat output by the heating system is approximately the desired input temperature to container 104. Designing heating system 112 in this way improves the cost effectiveness of the overall system (i.e., it is not oversized) while still producing efficient and effective drying of material 128.

Before discussing free water phase 404B, it is worth noting the duration of warm up phase 404A may vary according to a number of factors including, but not limited to: material 128's starting temperature, type of material, water content in the material, amount of vacuum applied, and the amount of material in the container. It is also worth noting that it is because of all these possible variables that prior art vacuum kiln systems have failed to repeatably and effectively dry materials without damaging the materials, either by under-drying the materials, or over-drying the materials.

As shown in FIG. 7, material temperature 612 slows once evaporation begins at the beginning of free water phase 404B. In an embodiment, process 500, at step 516, maintains a constant input temperature during this phase in the face of heat losses that occur due to the absorption of heat by material 128. In an embodiment, constant input temperature means that heat energy is being continuously supplied by the heating system, rather than, for example, cycling the heating system on and off.

Free water phase 604B continues until the steady convergence of input temperature 608 and the average material temperature 612. At this point it can be presumed that the fluid entrained in the material that is exterior to the cells of the structure (also referred to in the art as the "free water" in the material) has been substantially released (typically called the fiber saturation point, which is generally when the material has about 30% fluid).

Process 500 then proceeds to equalization phase 604C. During equalization phase 604C, the input temperature is maintained at a constant temperature for at least a predetermined amount of time. Equalization phase 604C allows for the entire mass of material to come to the same dryness. In an embodiment, the input temperature is maintained at a constant temperature for a period of several minutes to several days. In another embodiment or additionally to maintain a constant temperature for a predetermined amount of time, the input temperature can be maintained until the inlet temperature and the temperature at the outlet of platen assembly 108 or the wattage required to maintain set point is reduced. This convergence of temperatures is an indicator that material 128 is taking on no new heat and thus it can be presumed that all of material 128 is approximately at the same dryness. In another embodiment or additionally to maintain a constant temperature for a predetermined amount of time, the duty cycle of vacuum pump 156 is evaluated and used to determine whether material 128 has all reached the same dryness. Duty cycle can be used as a proxy because as less evaporation takes place, the less vacuum pump 156 needs to be turned on in order to keep a constant vacuum. In this way, the duty cycle is a proxy for the rate of evaporation occurring within container 104. In another embodiment or additionally to maintain a constant temperature for a predetermined amount of time, the air inlet temperature and the air outlet temperature proximate condenser 148 are monitored. The closer these two temperatures are to each other, the more likely that no new moisture is being release from material 128.

Process 500 then proceeds to finishing phase 604D. The input temperature is again maintained (supplemented as necessary by step 516). In an embodiment, the input temperature is increased similarly as it was during warm up phase 604D. In an embodiment, the maximum temperature is between about 60° F. and 100° F. In another embodiment, the maximum temperature is dependent upon the vacuum applied. In another exemplary embodiment, the maximum temperature is about 100° F. at 8 inHgA.

Figure 8:
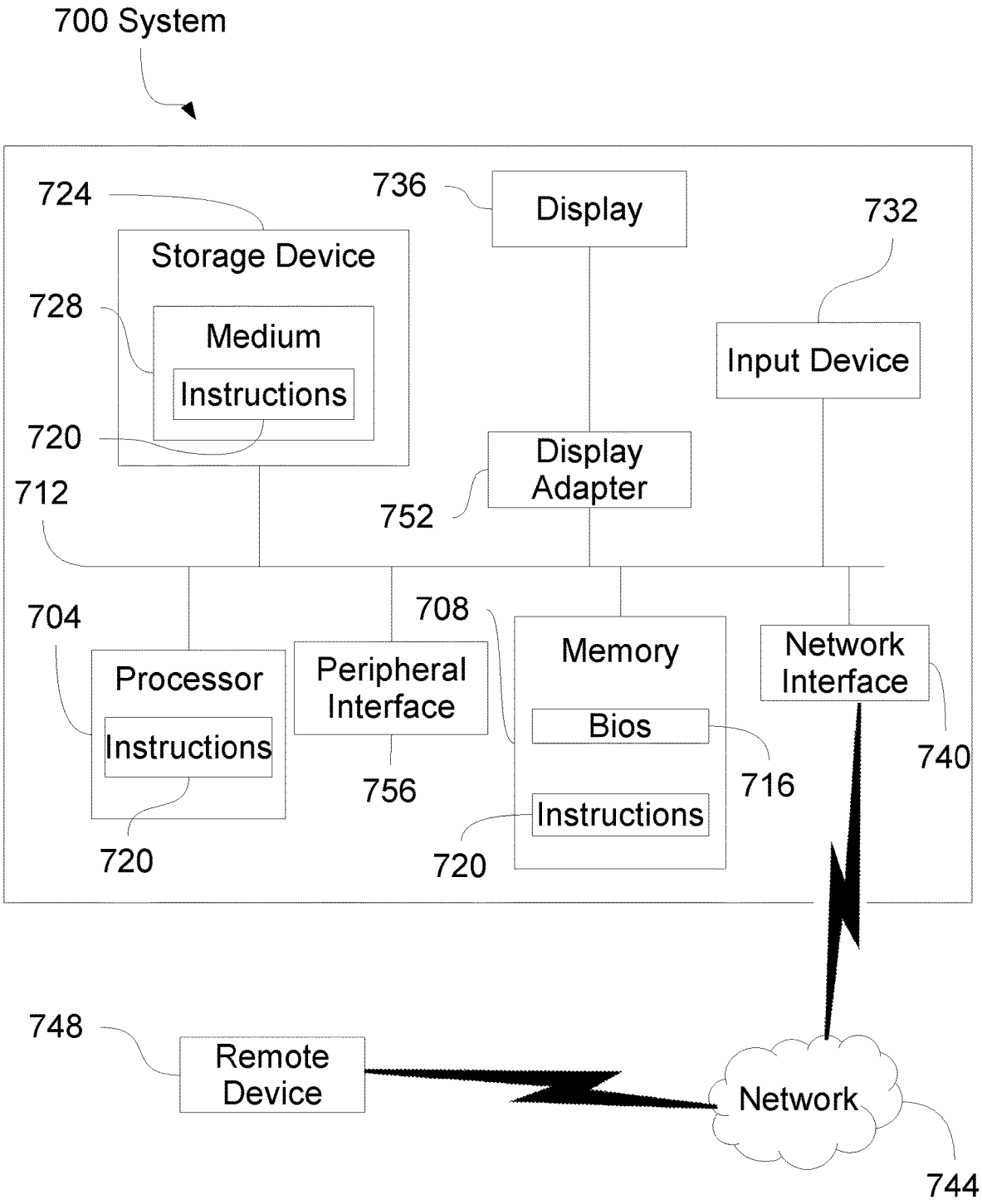
FIG. 8 is a block diagram of an exemplary computing system suitable for use with one or more of the components discussed herein.

FIG. 8 shows a diagrammatic representation of one embodiment of a computing device in the form of a system 700 within which a set of instructions for causing a device, such as control system 120 or PLC 204, to perform any one or more of the aspects and/or methodologies of the present disclosure may be executed, such as process 300 or process 500. It is also contemplated that multiple computing devices may be utilized to implement a specially configured set of instructions for causing the device to perform any one or more of the aspects and/or methodologies of the present disclosure. System 700 includes a processor 704 and a memory 708 that communicate with each other, and with other components, via a bus 712. Bus 712 may include any of several types of bus structures including, but not limited to, a memory bus, a memory controller, a peripheral bus, a local bus, and any combinations thereof, using any of a variety of bus architectures.

Memory 708 may include various components (e.g., machine readable media) including, but not limited to, a random-access memory component (e.g., a static RAM "SRAM", a dynamic RAM "DRAM", etc.), a read only component, and any combinations thereof. In one example, a basic input/output system 716 (BIOS), including basic routines that help to transfer information between elements within system 700, such as during start-up, may be stored in memory 708.

Memory 708 may also include (e.g., stored on one or more machine-readable media) instructions (e.g., software) 720 embodying any one or more of the aspects and/or methodologies of the present disclosure. In another example, memory 708 may further include any number of program modules including, but not limited to, an operating system, one or more application programs, other program modules, program data, and any combinations thereof.

System 700 may also include a storage device 724. Examples of a storage device (e.g., storage device 724) include, but are not limited to, a hard disk drive for reading from and/or writing to a hard disk, a magnetic disk drive for reading from and/or writing to a removable magnetic disk, an optical disk drive for reading from and/or writing to an optical medium (e.g., a CD, a DVD, etc.), a solid-state memory device, and any combinations thereof. Storage device 724 may be connected to bus 712 by an appropriate interface (not shown). Example interfaces include, but are not limited to, SCSI, advanced technology attachment (ATA), serial ATA, universal serial bus (USB), IEEE 1494 (FIREWIRE®), which is a registered trademark of Apple, Inc. of Cupertino, Calif., USA), and any combinations thereof. In one example, storage device 724 (or one or more components thereof) may be removably interfaced with system 700 (e.g., via an external port connector (not shown)). Particularly, storage device 724 and an associated machine-readable medium 728 may provide non-volatile and/or volatile storage of machine-readable instructions, data structures, program modules, and/or other data for system 700. In one example, instructions 720 may reside, completely or partially, within machine-readable medium 728. In another example, instructions 720 may reside, completely or partially, within processor 704.

System 700 may also include an input device 732. In one example, a user of system 700 may enter commands and/or other information into system 700 via input device 732. Examples of an input device 732 include, but are not limited to, an alpha-numeric input device (e.g., a keyboard), a pointing device, a joystick, a gamepad, an audio input device (e.g., a microphone, a voice response system, etc.), a cursor control device (e.g., a mouse), a touchpad, an optical scanner, a video capture device (e.g., a still camera, a video camera), touch screen, and any combinations thereof. Input device 732 may be interfaced to bus 712 via any of a variety of interfaces (not shown) including, but not limited to, a serial interface, a parallel interface, a game port, a USB interface, a FIREWIRE interface, a direct interface to bus 712, and any combinations thereof. Input device 732 may include a touch screen interface that may be a part of or separate from display 736, discussed further below. Input device 732 may be utilized as a user selection device for selecting one or more graphical representations in a graphical interface so as to provide inputs to control system 120. Input device 732 may also include, signal or information generating devices, such as sensors 208. The output of the input devices can be stored, for example, in storage device 724 and can be further processed by processor 704.

A user may also input commands and/or other information to system 700 via storage device 724 (e.g., a removable disk drive, a flash drive, etc.) and/or network interface device 740. A network interface device, such as network interface device 740 may be utilized for connecting system 700 to one or more of a variety of networks, such as network 744, and one or more remote devices 748 connected thereto. Examples of a network interface device include, but are not limited to, a network interface card (e.g., a mobile network interface card, a LAN card), a modem, and any combination thereof. Examples of a network include, but are not limited to, a cloud-based network, a wide area network (e.g., the Internet, an enterprise network), a local area network (e.g., a network associated with an office, a building, a campus or other relatively small geographic space), a telephone network, a data network associated with a telephone/voice provider (e.g., a mobile communications provider data and/or voice network), a direct connection between two computing devices, and any combinations thereof. A network, such as network 744, may employ a wired and/or a wireless mode of communication. In general, any network topology may be used. Information (e.g., data, instructions 720, etc.) may be communicated to and/or from system 700 via network interface device 740.

System 700 may further include a video display adapter 752 for communicating a displayable image to a display device, such as display device 736. Examples of a display device include, but are not limited to, a liquid crystal display (LCD), a cathode ray tube (CRT), a plasma display, a light emitting diode (LED) display, and any combinations thereof. Display adapter 752 and display device 736 may be utilized in combination with processor 704 to provide a graphical representation of the evaporation process. In addition to a display device, a system 700 may include one or more other peripheral output devices including, but not limited to, an audio speaker, a printer, and any combinations thereof. Such peripheral output devices may be connected to bus 712 via a peripheral interface 756. Examples of a peripheral interface include, but are not limited to, a serial port, a USB connection, a FIREWIRE connection, a parallel connection, and any combinations thereof.

In an embodiment, a drying process is disclosed for drying materials containing water, the drying process comprising: providing a container and a heating system, the heating system for heating the materials placed within the container, wherein the heating system is sized and configured to provide a fixed, maximum heat output, wherein the fixed, maximum heat output does not substantially exceed an amount of energy necessary to overcome the latent heat of vaporization once the water inside the material has started to boil; creating a vacuum within the container; heating the materials to an initial temperature such that water, contained within the material, begins to boil; increasing the heat output of the heating system to the fixed, maximum heat output; and continuously maintaining the fixed, maximum heat output throughout a free water phase and an equalization phase of the drying process. Additionally or alternatively, wherein the fixed, maximum heat output results in an operating temperature that is slightly greater than temperature required to release free water from the material. Additionally or alternatively, the drying process furthering including a heat control device and a plurality of sensors in communication with the heat control device. Additionally or alternatively, wherein each of the plurality of sensors is capable of sending a signal, representative of a temperature of a fluid used to heat the material, to the heat control device. Additionally or alternatively, the drying process further including a plurality of internal sensors in communication with the heat control device, each of the plurality of internal sensors in contact with a portion of the material and being capable of sending a signal, representative of a temperature of the inside of the material. Additionally or alternatively, wherein the heat control device controls a rate of evaporation of moisture from the material by adjusting the temperature of the fluid based upon a temperature difference, the temperature difference being determined by comparing a difference to the signals from the plurality of internal sensors, the difference being determined from the plurality of sensors. Additionally or alternatively, wherein a first one of the plurality of sensors monitors a sealed chamber fluid inlet temperature and wherein a second one of the plurality of sensors monitors a sealed chamber fluid outlet temperature. Additionally or alternatively, wherein a first one of the plurality of sensors monitors a sealed chamber air inlet temperature and wherein a second one of the plurality of sensors monitors a sealed chamber air outlet temperature. Additionally or alternatively, wherein a first one of the plurality of sensors monitors a heating system fluid inlet temperature and Additionally or alternatively, wherein the heat control device determines when the material has reached a fiber saturation point, the fiber saturation point being when the material has a moisture content of about 30%. Additionally or alternatively, wherein the heat control device determines when the material has a moisture content of about 6%. Additionally or alternatively, the drying process further including a depressurization system and wherein the depressurization system reduces a vacuum pressure in the container during the predetermined amount of time.

In another embodiment, a drying control system for a vacuum based drying system for drying a material in a vacuum chamber is disclosed, the drying control system comprising: a heat control device; a plurality of first sensors in communication with the heat control device, each of the plurality of first sensors is capable of sending a signal, representative of a temperature of a fluid used to heat the material, to the heat control device; and a plurality of second sensors in communication with the heat control device, each of the plurality of second sensors capable of sending a signal, representative of a temperature of the inside of the material, wherein the heat control device controls a rate of evaporation of moisture from the material by adjusting the temperature of the fluid based upon a temperature difference, the temperature difference being determined by comparing a difference to the signals from the plurality of second sensors, the difference being determined from the plurality of first sensors. Additionally or alternatively, wherein a first one of the plurality of first sensors monitors a vacuum chamber fluid inlet temperature and wherein a second one of the plurality of first sensors monitors a vacuum chamber fluid outlet temperature. Additionally or alternatively, wherein a first one of the plurality of first sensors monitors a heating system fluid inlet temperature and wherein a second one of the plurality of first sensors monitors a heating system fluid outlet temperature. Additionally or alternatively, wherein each of the plurality of second sensors is at least partially sealed inside the material. Additionally or alternatively, wherein the heat control device determines when the material has reached a fiber saturation point, the fiber saturation point being when the material has a moisture content of about 30%. Additionally or alternatively, wherein, when the material is at the fiber saturation point, the heat control device maintains a substantially constant fluid temperature input to the vacuum chamber for a predetermined amount of time. Additionally or alternatively, wherein the heat control device reduces a vacuum pressure in the vacuum chamber during the predetermined amount of time. Additionally or alternatively, wherein the heat control device adjusts the temperature of the fluid when the temperature difference is less than a predetermined temperature difference. Additionally or alternatively, wherein the predetermined temperature difference is less than 7 degrees Fahrenheit. Additionally or alternatively, wherein the heat control device further includes a processor, the processor including a set of instructions for adjusting the fluid temperature input to the vacuum chamber comprising: increasing the temperature of the fluid when the temperature difference is less than a predetermined amount; when the moisture in the material begins to evaporate, maintain the fluid at a first constant temperature; when the temperature of the material and the temperature of the fluid entering the vacuum chamber are approximately equal, increasing the temperature of the fluid; and when the material is at the fiber saturation point, maintaining the temperature of the fluid at a second constant fluid temperature.

In yet another embodiment, a vacuum drying system for drying a material in need thereof is disclosed, the vacuum drying system comprising: a vacuum chamber sized and configured to receive the material; a heating system coupled to the vacuum chamber and configured to transfer heat to the material, the heating system having an inlet temperature and an outlet temperature; and a plurality of temperature probes coupled to the heating system, the temperature probes positioned so as to measure a temperature drop occurring between an inlet of the vacuum chamber and an exit of the vacuum chamber. Additionally or alternatively, the vacuum drying system further including a drying control system comprising: a heat control device; a first sensor in communication with the heat control device, the first sensor capable of sending a signal, representative of a temperature of a fluid used to heat the material, to the heat control device; and a second sensor in communication with the heat control device, the second sensor capable of sending a signal, representative of a temperature of the inside of the material, wherein the heat control device controls a rate of evaporation of moisture from the material by adjusting the temperature of the fluid based upon a temperature difference, the temperature difference being determined by comparing the signal from the first sensors and the signal form the second sensor. Additionally or alternatively, the vacuum drying system further including a condenser fluidly coupled to the vacuum chamber. Additionally or alternatively, wherein the heating system operates as a closed-loop system. Additionally or alternatively, wherein the heating system includes a plurality of plates, wherein each of the plurality of plates includes a fluid passage inside the plate. Additionally or alternatively, wherein the heating system includes a plurality of plates, wherein each of the plurality of plates is heated using electric resistance heating elements. Additionally or alternatively, wherein the heating system produces heated air for use in the vacuum chamber. Additionally or alternatively, further including a vacuum pump. Additionally or alternatively, wherein the drying control system ensures that a surface temperature of the material is not significantly more than an internal temperature of the material. Additionally or alternatively, wherein the drying control system determines when the material has reached a fiber saturation point, the fiber saturation point being when the material has a moisture content of about 30%. Additionally or alternatively, wherein, when the material is at the fiber saturation point, the drying control system maintains a substantially constant inlet temperature to the vacuum chamber for a predetermined amount of time. Additionally or alternatively, wherein the drying control system reduces the vacuum pressure in the vacuum chamber during the predetermined amount of time. Additionally or alternatively, wherein, when the material is at the fiber saturation point, the drying control system maintains a substantially constant inlet temperature to the vacuum chamber until a predetermined temperature differential is reached between the inlet temperature and the outlet temperature of the heating system.

In a further embodiment, a drying control system is disclosed for use with a vacuum based drying system for drying materials, the vacuum based drying system including a vacuum chamber, a heating system having an inlet and an outlet, and a plurality of temperature probes coupled to the material, the drying control system comprising: a heat control device including a processor, the processor including a set of instructions for adjusting the temperature of a fluid provided to the vacuum chamber, the instructions comprising: increasing the temperature of the fluid when a temperature difference is less than a predetermined amount; when the moisture in the material begins to boil, maintain the fluid at a first constant temperature; when the temperature of the material and the temperature of the temperature of the fluid entering the vacuum chamber are approximately equal, increasing the temperature of the fluid; and when the material is at the fiber saturation point, maintaining the temperature of the fluid at a second constant fluid temperature.

In yet another embodiment, a method of drying materials in need thereof in a vacuum chamber is disclosed, the method comprising: heating the materials under vacuum; monitoring a fluid temperature entering and exiting the vacuum chamber; and adjusting the fluid temperature entering and exiting the vacuum chamber based upon a difference between the temperature entering and exiting the vacuum chamber.

Exemplary embodiments have been disclosed above and illustrated in the accompanying drawings. It will be understood by those skilled in the art that various changes, omissions, and additions may be made to that which is specifically disclosed herein without departing from the spirit and scope of the present invention.

What is claimed is:

1. A drying process for drying materials containing water, the drying process comprising:

providing a container and a heating system, the heating system for heating the materials placed within the container, wherein the heating system is sized and configured to provide a fixed, maximum heat output, wherein the fixed, maximum heat output does not substantially exceed an amount of energy necessary to overcome a latent heat of vaporization once the water inside the materials has started to boil;

creating a vacuum within the container; providing a heat output of the heating system such that an input temperature is maintained within 1° F. and 10° F. of an average materials temperature of the materials until water contained within the materials begins to boil increasing, when the average materials temperature drops due to the water within the materials beginning to boil; the heat output of the heating system to the fixed, maximum heat output; and continuously maintaining the fixed, maximum heat output until the input temperature and the average materials temperature begin to converge after which the input temperature is increased until the input temperature and the average materials temperature begin to track each other closely after which the input temperature is maintained at a constant temperature for a predetermined amount of time.

2. The drying process according to claim 1, wherein the fixed, maximum heat output results in an operating temperature that is slightly greater than temperature required to release free water from the material.

3. The drying process according to claim 1, furthering including a heat control device and a plurality of sensors in communication with the heat control device.

4. The drying process according to claim 3, wherein each of the plurality of sensors is capable of sending a signal, representative of a temperature of a fluid used to heat the material, to the heat control device.

5. The drying process according to claim 4, further including a plurality of internal sensors in communication with the heat control device, each of the plurality of internal sensors in contact with a portion of the materials and being capable of sending a signal, representative of a temperature of the inside of the material.

6. The drying process according to claim 5, wherein the heat control device controls a rate of evaporation of moisture from the materials by adjusting the temperature of the fluid based upon a temperature difference, the temperature difference being determined by comparing a difference to the signals from the plurality of internal sensors, the difference being determined from the plurality of sensors.

7. The drying process according to claim 3, wherein a first one of the plurality of sensors monitors a sealed chamber fluid inlet temperature and wherein a second one of the plurality of sensors monitors a sealed chamber fluid outlet temperature.

8. The drying process according to claim 3, wherein a first one of the plurality of sensors monitors a sealed chamber air inlet temperature and wherein a second one of the plurality of sensors monitors a sealed chamber air outlet temperature.

9. The drying process according to claim 3, wherein a first one of the plurality of sensors monitors a heating system fluid inlet temperature and wherein a second one of the plurality of sensors monitors a heating system fluid outlet temperature.

10. The drying process according to claim 3, wherein the heat control device determines when the materials have reached a fiber saturation point, the fiber saturation point being when the material has a moisture content of about 30%.

11. The drying process according to claim 10, wherein the heat control device determines when the materials have a moisture content of about 6%.

12. The drying process according to claim 10, further including a depressurization system and wherein the depressurization system reduces a vacuum pressure in the container during the predetermined amount of time.

* * * * *